US009057348B2

(12) United States Patent
Usui et al.

(10) Patent No.: US 9,057,348 B2
(45) Date of Patent: Jun. 16, 2015

(54) PULSATION DAMPER

(75) Inventors: Takashi Usui, Toyota (JP); Yoshinori Takeuchi, Toyota (JP); Takeyuki Yabuuchi, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 235 days.

(21) Appl. No.: 13/256,550

(22) PCT Filed: Mar. 17, 2009

(86) PCT No.: PCT/JP2009/055202

§ 371 (c)(1),
(2), (4) Date: Sep. 14, 2011

(87) PCT Pub. No.: WO2010/106645

PCT Pub. Date: Sep. 23, 2010

(65) Prior Publication Data

US 2012/0006303 A1 Jan. 12, 2012

(51) Int. Cl.
*F02M 69/46* (2006.01)
*F02M 55/04* (2006.01)
(Continued)

(52) U.S. Cl.
CPC ..... *F02M 55/04* (2013.01); *F02M 59/44* (2013.01); *F02M 2200/315* (2013.01); *F04B 53/003* (2013.01)

(58) Field of Classification Search
CPC . F02M 2200/315; F02M 55/04; F02M 59/44; F02M 53/003
USPC ..... 123/445, 495, 446, 447, 467, 510, 511; 417/540
See application file for complete search history.

(56) References Cited

U.S. PATENT DOCUMENTS 3,125,033 A * 3/1964 Marye ..... 417/540
3,958,547 A * 5/1976 Ogawa ..... 123/198 D
(Continued)

FOREIGN PATENT DOCUMENTS

EP 1411236 A2 4/2004
JP 6-14501 U 2/1994
(Continued)

OTHER PUBLICATIONS

130625 JP 2004-138071 english machine translation.pdf.*
(Continued)

*Primary Examiner* — Erick Solis
*Assistant Examiner* — Carl Staubach
(74) *Attorney, Agent, or Firm* — Sughrue Mion, PLLC

(57) ABSTRACT

A pulsation damper mounted in a fuel chamber (23) of a high-pressure fuel pump (20) is provided with a diaphragm (11) having a flat section (11*a*) displaced when fuel pressure is applied thereto, a pump cover (10) for supporting the diaphragm (11), and a gas chamber (12) formed by the diaphragm (11) and the pump cover (10). Pressure pulsation occurring in the fuel chamber (23) is suppressed by displacement of the flat section (11*a*). The diaphragm (11) is formed in a closed-bottomed tubular shape with the flat section (11*a*) located at the bottom and has a projection (11*b*) provided to the periphery of the flat section (11*a*) and projecting to the side opposite to the pump cover (10). A tubular peripheral section extending from the outer periphery of the projection (11*b*) so as to be vertical to the flat section (11*a*) is fitted over the pump cover (10). The externally fitting portion of the tubular peripheral section is a joint section (11*c*) joined to the pump cover (10).

5 Claims, 4 Drawing Sheets

(51) Int. Cl.
*F02M 59/44* (2006.01)
*F04B 53/00* (2006.01)

(56) References Cited

U.S. PATENT DOCUMENTS

| | | | | |
|---|---|---|---|---|
| 4,649,884 | A * | 3/1987 | Tuckey | 123/457 |
| 5,117,873 | A * | 6/1992 | Miyakawa et al. | 138/30 |
| 5,215,124 | A * | 6/1993 | Hattori et al. | 138/30 |
| 5,934,251 | A * | 8/1999 | Jacobs | 123/447 |
| 6,901,912 | B1 | 6/2005 | Onishi et al. | |
| 7,654,249 | B2 * | 2/2010 | Fischer et al. | 123/446 |
| 8,366,421 | B2 * | 2/2013 | Munakata et al. | 417/540 |
| 2008/0175735 | A1 * | 7/2008 | Lucas et al. | 417/540 |
| 2008/0276911 | A1 * | 11/2008 | Woody | 123/517 |
| 2013/0052064 | A1 * | 2/2013 | Oikawa et al. | 417/540 |

FOREIGN PATENT DOCUMENTS

| | | | |
|---|---|---|---|
| JP | 09-151829 | A | 6/1997 |
| JP | 11-013701 | A | 1/1999 |
| JP | 2001-248518 | A | 9/2001 |
| JP | 2004-138071 | A | 5/2004 |
| JP | 2007-138805 | A | 6/2007 |
| JP | 2008-002361 | A | 1/2008 |
| JP | 2008-019728 | A | 1/2008 |
| JP | 2008-286144 | A | 11/2008 |

OTHER PUBLICATIONS

130625 JP 2008-019728 english machine translation.pdf.*
130625 JP 2004-138071 english machine translation.pdf, document machine translated on Jun. 25, 2013. Author Helmut et al. Japanese document published in 2004.*
130625 JP 2008-019728 english machine translation.pdf, document machine translated on Jun. 25, 2013. Author Katsunori. Japanese document published in 2008.*
International Preliminary Report on Patentability in International Application No. PCT/2009/055202.
International Preliminary Report on Patentability in International Application No. PCT/2009/055202, PCT Application Year 2009, English translation of International Preliminary Report Mar. 21, 2011.

* cited by examiner

PULSATION DAMPER

CROSS REFERENCE TO RELATED APPLICATION

This application is a National Stage of International Application No. PCT/JP2009/055202 filed Mar. 17, 2009, the contents of all of which are incorporated herein by reference in their entirety.

FIELD OF THE INVENTION

The present invention relates to a pulsation damper, particularly to a pulsation damper that is integrally provided to a high-pressure fuel pump for feeding high pressure fuel to the delivery pipe of an in-cylinder injection internal combustion engine that uses gasoline as fuel, and reduces pulsations generated by the operation of the pump.

BACKGROUND ART

As is known, an in-cylinder injection internal combustion engine using gasoline as fuel includes a high-pressure fuel pump that receives fuel pumped up from a fuel tank by a fuel pump, pressurizes the fuel to a pressure higher than the discharge pressure of the fuel pump, and sends the pressurized fuel to a delivery pipe (high-pressure piping) connected to an injector serving as a fuel injection device. Typically, in an internal combustion engine having such a high-pressure fuel pump, the pressure of fuel that has been pumped up from the fuel tank by the fuel pump is maintained at a "feed pressure", which is not more than 400 kPa when the fuel is supplied to a fuel chamber formed in the high fuel pressure fuel pump. Fuel that has been supplied to the fuel chamber is then sent from the fuel chamber to a pressurizing chamber in a cylinder via an electromagnetic valve. When the amount of fuel in the pressurizing chamber is adjusted to a predetermined amount by an upward motion of a plunger vertically reciprocating in the cylinder, the electromagnetic valve is closed. When the electromagnetic valve is closed, the fuel is pressurized as the plunger is moved upward, and sent under pressure to the delivery pipe via a check valve. The pressure of fuel sent under pressure from the pressurizing chamber is variable between 4 to 13 MPa in accordance, for example, closing timing of the electromagnetic valve. Then, the fuel of which the pressure has been accumulated in the delivery pipe, is directly injected into the cylinders of the engine by valve opening of the injector. At this time, the amount of fuel that flows into the fuel chamber of the high-pressure fuel pump from the fuel pump per unit time is not necessarily equal to the amount of fuel that flows out from the fuel chamber to the pressurizing chamber in the cylinder per unit time. The difference in the fuel amount causes pulsations in the fuel pressure in the fuel chamber. Also, in such a high-pressure fuel pump, fuel that is being pressurized after being sent from the fuel chamber to the pressurizing chamber of the cylinder is returned to the fuel chamber, so that the amount of fuel sent from the pump to the delivery pipe is adjusted. Therefore, the pressure difference between the fuel in a section including the fuel chamber and the fuel that is being pressurized also generates pulsations of the fuel pressure in the fuel chamber. Such pressure pulsation of fuel, in other words, variation in pressure, varies the amount of fuel sent from the fuel chamber to the pressurizing chamber in the cylinder. This contributes to degradation of the adjustment accuracy of the amount of fuel sent from the high-pressure fuel pump to the delivery pipe.

Accordingly, high-pressure fuel pumps disclosed in Patent Documents 1 and 2 each have a pulsation damper that absorbs pressure pulsation of fuel in a fuel chamber, so as to reduce pressure pulsation described above.

The pulsation damper disclosed in Patent Document 1 has a cross-sectional structure shown in FIG. 9. That is, the pulsation damper has two sets of two diaphragms 71*a*, 71*b* provided in a fuel chamber 75 defined in a housing 70. The diaphragms 71*a*, 71*b* have outer peripheral joint sections 73*a*, 73*b*, which are welded to each other and supported by a support member 74. Each set of the diaphragms 71*a*, 71*b* has a gas chamber 72*a*, 72*b* between two diagrams. The gas chambers 72*a*, 72*b* are filled with inert gas of a predetermined pressure, for example, argon gas or nitrogen gas. The volume of the gas chambers 72*a*, 72*b* changes in accordance with the fuel pressure in the fuel chamber 75, so that pressure pulsation as described above is absorbed. The fuel chamber 75 receives fuel from a fuel tank (not shown) via a fuel passage 76 connected to the fuel chamber 75.

The pulsation damper disclosed in Patent Document 2 has a cross-sectional structure shown in FIG. 10 and includes a plate member 83 and a diaphragm 81. The plate member 83 forms a fuel chamber 85 with a housing 84. The plate member 83 and the diaphragm 81 are welded to each other at a joint section 81*a* at the periphery. An annular member 86 is provided along the joint section 81*a*. The plate member 83 is covered with a pump cover 80. A gas chamber 82 defined by the plate member 83 and the diaphragm 81 is filled with inert gas of a predetermined pressure, like the pulsation damper disclosed in Patent Document 1. In accordance with the fuel pressure in the fuel chamber 85, the diaphragm 81 is displaced into the fuel chamber 85 or toward the plate member 83, thereby absorbing pressure pulsation of fuel.

With either of the pulsation damper of Patent Document 1 or 2, when pressure pulsation of fuel occurs in the fuel chamber, the diaphragm is deformed in accordance with the pressure pulsation in a direction to increase or reduce the volume of the gas chamber. This absorbs the pressure pulsation, thereby reducing changes in the fuel pressure.

In either of these pulsation dampers, when the volume of the gas chamber changes due to deformation of the diaphragm, a force resulting from the pressure of gas filling the gas chamber acts on members forming the outer periphery of the gas chamber including the joint sections, that is, acts on the diaphragms and the plate member. The force acts from within the gas chamber toward the outside of the gas chamber. Thus, when the force acts on the joint sections, it acts to separate joined members, specifically, the joined diaphragms or the joined diaphragm and plate member. Such a force acts on the joint section each time the diaphragms are deformed due to pressure pulsation. Although the force does not completely separate the joined members from each other, the force causes delamination from the innermost parts of the joint sections. In other words, joint loosening occurs. Therefore, these pulsation dampers need to have members for preventing joint loosening such as the support member 74 (Patent Document 1) or the annular member 86 (Patent Document 2), which apply force for pressing joined members against each other.

Patent Document 1: Japanese Laid-Open Patent Publication No. 2008-19728

Patent Document 2: Japanese Laid-Open Patent Publication No. 2008-2361

SUMMARY OF THE INVENTION

Accordingly, it is an objective of the present invention to provide a pulsation damper that, despite a simple structure, is capable of maintaining high reliability at a joint section of a diaphragm that is integrated with a high-pressure fuel pump and operates together with a gas chamber to inhibit pressure pulsations of fuel.

To achieve the foregoing objective and in accordance with the present invention, a pulsation damper for a fuel chamber of a high-pressure fuel pump is provided. The pulsation damper includes a diaphragm and a support member. The diaphragm has a displacement section that is displaced by pressure acting there against. The diaphragm reduces pressure pulsation in the fuel chamber by means of displacement of the displacement section. The support member supports the diaphragm, and, together with the diaphragm, forms a gas chamber. The diaphragm is shaped like a lidded cylinder and has a bottom formed by the displacement section and a cylindrical circumferential section extending perpendicularly from the displacement section. The cylindrical circumferential section has a fitting section that is joined to the support member while being fitted to the support member.

In the above configuration, the cylindrical circumferential section extends from the displacement section of the diagram at a right angle. While being fitted to the support member for the diaphragm, the fitting portion of the cylindrical circumferential section is joined to the support member. Accordingly, the joint section and the displacement section are perpendicular to each other. That is, if the pressure caused by changes in volume of the gas chamber due to displacement of the displacement section acts on the joint section between the cylindrical circumferential section and the support member, the pressure does not act in a direction for separating the fitting portion from the support section. Therefore, the reliability at the joint section between the diaphragm and the support member is maintained at a high level.

According to one aspect of the present invention, the displacement section includes an annular projection and a flat section surrounded by the projection. The annular projection is continuous to the cylindrical circumferential section and has an arcuately bulging cross-sectional shape in the direction opposite to the support member. The cylindrical circumferential section is perpendicular to the flat section.

The stress generated in the diaphragm by pressure applied to the displacement section thereof concentrates on a part that is continuous to the cylindrical circumferential section, which extends in a direction perpendicular to the displacement section, that is, on the periphery of the displacement section. In this regard, the projection that has an arcuately bulging cross-sectional shape in the direction opposite to the support member is formed on the periphery of the displacement section, on which stress is concentrated. Also, the remainder of the displacement section is formed to be flat to increase the area for receiving stress concentrated on the periphery. This relaxes the stress acting on the diaphragm. This allows the reliability at the joint section to be maintained at a high level, and therefore further improves the pressure tolerance as a pulsation damper.

According to one aspect of the present invention, the support member is a pump cover for the high-pressure fuel pump.

According to this configuration, the pump cover of the high-pressure fuel pump, to which the pulsation damper is attached, is used as the support member for the diaphragm of the pulsation damper. Thus, compared to a configuration with an additional support member for supporting the diaphragm, the number of components of the high-pressure fuel pump is reduced, and the size of the high-pressure fuel pump is minimized.

In accordance with one aspect of the present invention, the pump cover partially has a low rigidity section with low rigidity.

According to this configuration, the low rigidity section of the pump cover correspondingly increases the amount of displacement of the pump cover in response to the pressure applied to the displacement section of the diaphragm. That is, in addition to the diaphragm having the displacement section, the cover serving as the support member can absorb pressure changes in fuel, in other words, pressure pulsation. This increases the range of pressure pulsation that can be absorbed by the entire pulsation damper, and therefore improves pulsation reducing performance.

The low rigidity section is, for example, formed by attaching the pump cover to the upper end cylindrical section of a housing of the high-pressure fuel pump, and reducing the thickness of the part that is attached to the upper end cylindrical section so that it has a lowered rigidity. Alternatively, the thickness is reduced in a part of the pump cover to which the cylindrical circumferential section of the diaphragm is joined to form the low rigidity section. Further, the thickness is reduced in a part of the pump cover that faces the displacement section of the diaphragm to form the low rigidity section. These possible structures are all effective.

According to these configurations, it is possible to expand the range of pressure that can be absorbed by the pulsation damper simply by reducing the thickness in a part of the material of the pump cover to form a low rigidity section.

DETAILED DESCRIPTION OF THE PREFERRED EMBODIMENTS

A pulsation damper according to one embodiment of the present invention will now be described with reference to FIGS. 1 and 2.

Figure 1:
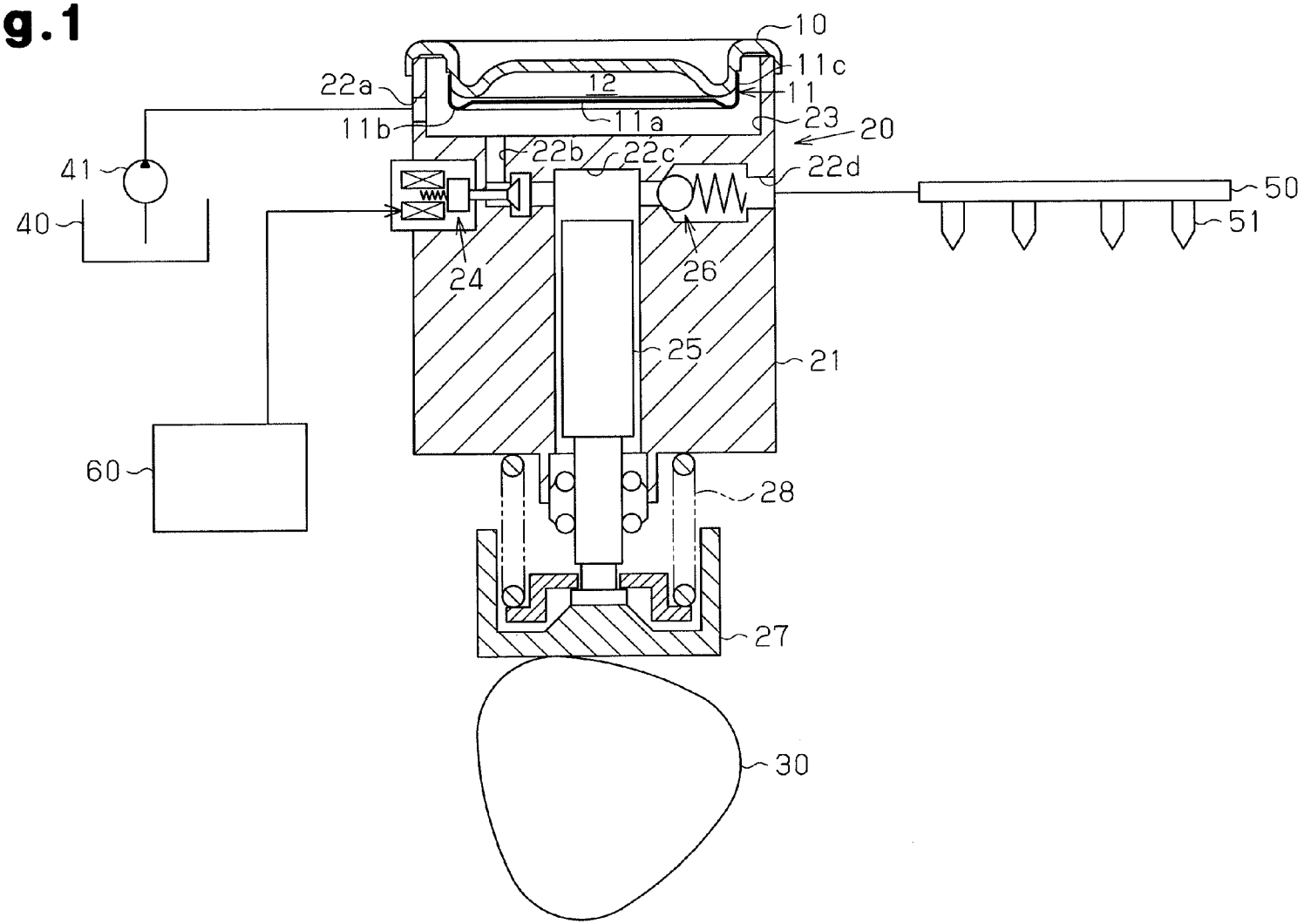
FIG. 1 is a cross-sectional view with a block diagram, showing a high-pressure fuel pump and surrounding configuration, in which a pulsation damper according to one embodiment of the present invention is used.

FIG. 1 schematically shows a high-pressure fuel pump 20 having a pulsation damper according to the present embodiment and a surrounding structure, or a fuel supply system. The high-pressure fuel pump 20 is attached, for example, to a cylinder head cover of an in-cylinder injection internal combustion engine that uses gasoline as fuel.

As shown in FIG. 1, the high-pressure fuel pump 20 has a housing 21, in which a fuel inlet 22*a* and a fuel chamber 23 are provided. Fuel that has been pumped by a fuel pump (feed pump) 41 flows into the fuel inlet 22*a*. The fuel is then temporarily retained in the fuel chamber 23. Also, fuel retained in the fuel chamber 23 is sent to a pressurizing chamber 22*c* in a cylinder via a fuel communication passage 22*b* and an electromagnetic valve 24. The fuel is then pressurized by a plunger 25 in the pressurizing chamber 22*c*, and the pressurized fuel is sent under pressure to a delivery pipe 50 via a check valve 26 and a fuel outlet 22*d*.

In this high-pressure fuel pump 20, the fuel chamber 23 has an opening upper end, and the opening is covered with a pulsation damper. The pulsation damper includes a pump cover 10 and a diaphragm 11 joined to the pump cover 10. The diaphragm 11 has a flat section 11*a*, a projection 11*b*, and a joint section 11*c*. The projection 11*b* is formed to surround the flat section 11*a* and has an arcuate cross-sectional shape bulging toward the fuel chamber 23. The joint section 11*c* is joined to the pump cover 10. The electromagnetic valve 24 is located in the fuel communication passage 22*b*, which connects the fuel chamber 23 and the pressurizing chamber 22*c* to each other. The electromagnetic valve 24 is a normally closed open type. That is, the electromagnetic valve 24 is closed only when the coil is energized, and closes the fuel communication passage 22*b*. Energization of the electromagnetic valve 24 is controlled by an electronic control unit 60, which controls the operational state of the in-cylinder injection internal combustion engine. Further, a plunger 25 is provided in the cylinder. An end of the plunger 25 opposite to the pressurizing chamber 22*c* is coupled to a lifter 27, while the plunger 25 is urged toward the bottom dead center by a spring 28. The bottom of the lifter 27 is pressed against a pump cam 30, which is provided on and rotates integrally with a camshaft. Each time the cam nose of the pump cam 30 lifts the lifter 27, the plunger 25 is moved upward to pressurize fuel in the pressurizing chamber 22*c*.

In the fuel supply system including the high-pressure fuel pump 20 as described above, fuel stored in the fuel tank 40 is supplied to the fuel inlet 22*a* of the high-pressure fuel pump 20 at a discharge pressure, for example, of 400 kPa by the fuel pump (feed pump) 41. The fuel that has been supplied to the high-pressure fuel pump 20 is temporarily retained in the fuel chamber 23, and is then delivered to the pressurizing chamber 22*c* via the fuel communication passage 22*b* on condition that the plunger 25 is moving downward in the cylinder and that the electromagnetic valve 24 is in the open state (non-energized state). Thereafter, as the plunger 25 is moved upward, the fuel that has been sent to the pressurizing chamber 22*c* starts being pressurized. While the electromagnetic valve 24 is open, the fuel is not provided to the fuel outlet 22*d*, but is returned to the fuel chamber 23 via the fuel communication passage 22*b*. Then, when the electromagnetic valve 24 is closed based on energization by the electronic control unit 60, the pressure of fuel in the pressurizing chamber 22*c* is increased, for example, to 4 to 13 MPa. The pressurized fuel is provided under pressure from the fuel outlet 22*d* to the delivery pipe 50 via the check valve 26. In the high-pressure fuel pump 20 as described above, it is possible to control the amount and pressure of fuel delivered under pressure to the delivery pipe 50 by controlling the valve closing timing of the electromagnetic valve 24 when the plunger 25 is moved upward. In this manner, fuel stored under pressure in the delivery pipe 50 is injected into the cylinders of the engine when the injector 51 is opened.

In the above described fuel supply system, the amount of fuel supplied per unit time to the high-pressure fuel pump 20, particularly to the fuel chamber 23 by the fuel pump 41 is not necessary equal to the amount of fuel supplied to the pressurizing chamber 22*c* from the fuel chamber 23 via the electromagnetic valve 24. Therefore, due to the difference between the amount of fuel supplied to and the amount of fuel discharged from the fuel chamber 23, variation of fuel pressure, or pressure pulsation occurs. In addition, the fuel that is being pressurized as the plunger 25 is moved upward in the pressurizing chamber flows back to the fuel chamber 23 before the electromagnetic valve 24 is closed. This is also a cause of pressure pulsation. Such pressure pulsation is absorbed by the pulsation damper provided to cover the opening of the fuel chamber 23.

Next, the configuration of the pulsation damper, which absorbs pressure pulsation of fuel in the high-pressure fuel pump 20 and the mechanism of absorption of pressure pulsation will be described with reference to FIG. 2.

Figure 2:
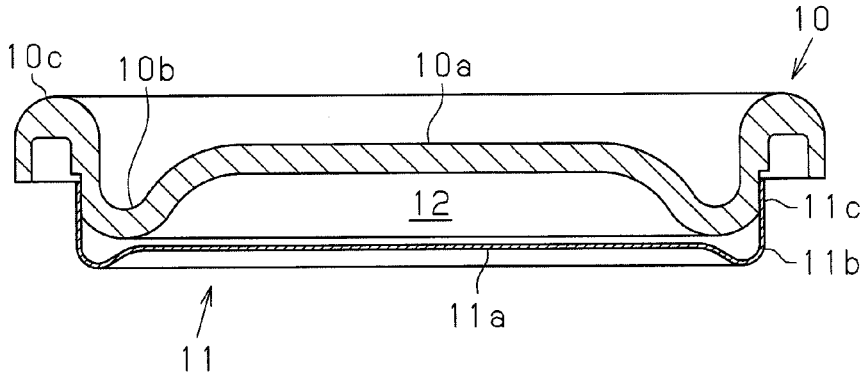
FIG. 2 is a cross-sectional view showing the cross-sectional structure of the pulsation damper according to the same embodiment.

FIG. 2 shows the cross-sectional structure of the pulsation damper according to the present embodiment. As shown in FIG. 2, the pulsation damper includes the pump cover 10, which covers the opening of the high-pressure fuel pump 20 (FIG. 1), and the diaphragm 11, which is supported by the pump cover 10. The diaphragm 11 contacts fuel retained in the fuel chamber 23 (FIG. 1) and is therefore acted upon by the pressure of the retained fuel. In the present embodiment, the diaphragm 11 is formed like a lidded cylinder with the flat section 11*a* and the annular projection 11*b* surrounding the flat section 11*a*. The flat section 11*a* occupies most of the surface area of the diaphragm 11. The pressure of the fuel applied to the flat section 11*a* in a concentrated manner. The projection 11*b* bulges into the fuel chamber 23 and has an arcuate cross-sectional shape. That is, a cylindrical circumferential section is provided on the outer periphery of the projection 11*b*. The cylindrical circumferential section is perpendicular to the flat section 11*a* forming the bottom and extends in a direction opposite to the bulging direction of the projection 11*b*. The diaphragm 11 is formed of stainless steel material such as SUS631 (precipitate hardened steel), for example, through pressing to have the described shape. The pump cover 10 also includes a flat section 10*a* and an annular projection 10*b* surrounding the flat section 10*a*. When the pulsation damper is assembled, the flat section 10*a* of the pump cover 10 is parallel to the flat section 11*a* of the diaphragm 11, and the projection 10*b* bulges toward the diaphragm 11. Also, a circumferential section is provided on the outer periphery of the projection 10*b*. The circumferential section extends in a direction opposite to the bulging direction of the projection 10*b*. A hook section 10*c* is provided at the upper end of the circumferential section. The hook section 10*c* is hooked to the upper end of the opening of the housing 21 (FIG. 1). The pump cover 10 is formed of stainless steel material such as SUS430 (ferritic stainless steel), for example, through pressing to have the described shape.

When assembling the pump cover 10 and the diaphragm 11 together, the distal end of the circumferential section of the diaphragm 11 that is perpendicular to the flat section 11*a* and extends in the direction opposite to the bulging direction of the projection 11*b* is press-fitted about the circumferential section of the pump cover 10 that is perpendicular to the flat section 10*a* and extends in the direction opposite to the bulging direction of the projection 10*b*. The press-fitted section is fixed to the circumferential section of the pump cover 10, which serves as a support member, by welding. In FIGS. 1 and 2, a part of the diaphragm 11 that is fixed by welding is referred to as the joint section (fitting section) 11*c*. When these members are fitted to each other, the gas chamber 12, which is defined by the pump cover 10 and the diaphragm 11, is filled with inert gas such as argon gas or nitrogen gas, at predetermined pressure, such as 400 kPa. The gas is sealed in the gas chamber 12. When the pump cover 10 and the diaphragm 11 are welded to each other, laser welding can be employed in which laser energy of carbon dioxide gas laser or YAG laser is used. Alternatively, resistance welding can be employed in which two members to be welded are pressed against each other and provided with electric current, so that resistance heat melts the members to be welded.

In the pulsation damper, which is configured as described above to be integrally assembled with the high-pressure fuel pump 20 (FIG. 1), the flat section 11*a* of the diaphragm 11, which is exposed to the fuel in the fuel chamber 23 (FIG. 1), receives pressure pulsation of fuel, which is generated when the above described high-pressure fuel pump 20 (FIG. 1) operates. Since the applied fuel pressure, particularly the pressure of fuel that is being pressurized in the pressurizing chamber 22*c* (FIG. 1) is normally higher than the pressure of the inert gas sealed in the gas chamber 12, the flat section 11*a* of the diaphragm 11 is deformed toward the pump cover 10. That is, the deformation reduces the volume of the gas chamber 12. This absorbs the pressure of fuel. Further, in the pulsation damper according to the present embodiment, when welding the diaphragm 11 to the pump cover 10, a part of the joint section 11*c* where these members are overlapped is perpendicular to the flat section 11*a*, which receives the pressure of fuel. Thus, when pressure pulsation of fuel occurs, the joint section 11*c* only receives shearing load. Also, due to the decrease in the volume of the gas chamber 12, the pressure of the sealed gas acting on the joint section 11*c* acts in a direction substantially parallel to the joint section 11*c*. Since such pressure never acts to separate overlapped parts of the pump cover 10 and the diaphragm 11 in the joint section 11*c*, the above described joint loosening is not likely to occur.

Figure 9:
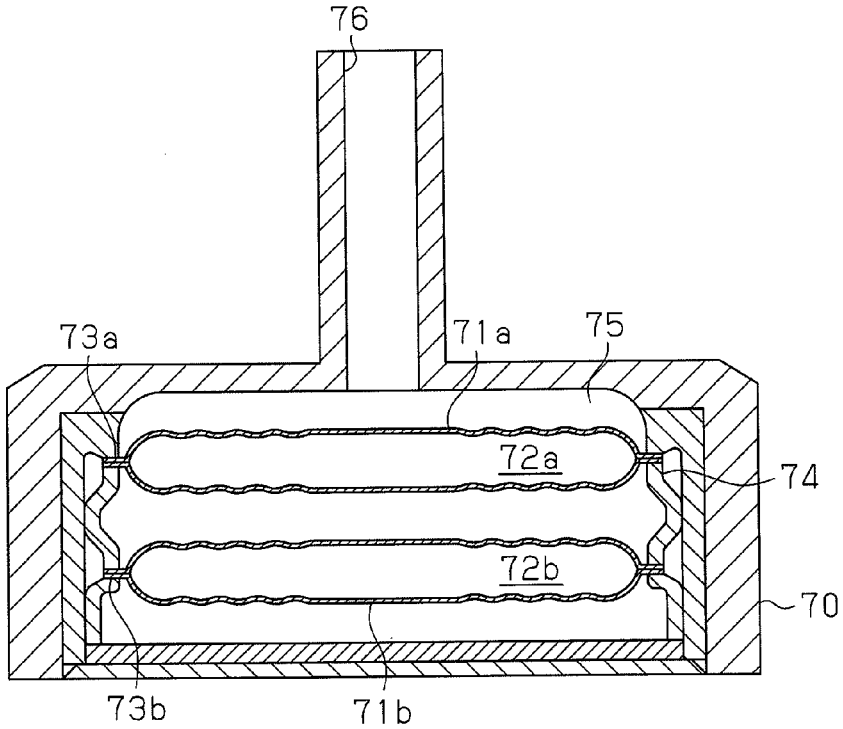
FIG. 9 is a cross-sectional view showing the cross-sectional structure of a pulsation damper according to prior art.

The present inventors found out that when the same pressure was applied to both the prior art pulsation damper configured as shown in FIG. 9 and the pulsation damper of the present embodiment, joint loosening, or delamination of the overlapped parts reached 300 μm at maximum in the prior art pulsation damper, and joint loosening was significantly smaller at 0.05 μm in the pulsation damper of the present embodiment.

Figure 10:
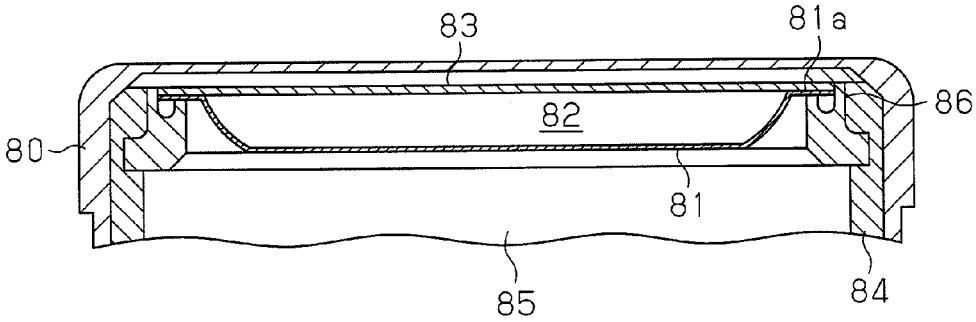
FIG. 10 is a cross-sectional view showing the cross-sectional structure of a pulsation damper according to another prior art.

In the case of the prior art pulsation damper shown in FIG. 10, when fuel pressure is applied to the flat section of the diaphragm 81, the stress generated due to deformation of the diaphragm 81 concentrates on the bent section. In contrast, in the pulsation damper according to the present embodiment, the projection 11*b* is provided about the flat section 11*a* of the diaphragm 11. The stress generated due to deformation of the diaphragm 11 is relaxed by the projection 11*b*. That is, compared to the prior art pulsation damper, the area in which stress is concentrated can be enlarged, so that the maximum value of the stress is lowered. Therefore, when designing pulsation dampers assuming that the maximum value of stress that acts on the section is the same, the separation damper of the present embodiment can have a diaphragm of a larger diameter or a less thickness than that in the prior art pulsation damper. The amount of displacement of a diaphragm is proportional to the 4th power of its radius and inversely proportional to the 3rd power of the thickness. Accordingly, the pulsation damper of the present embodiment can have a larger displacement amount than the prior art pulsation damper. In other words, without increasing the number of the diaphragm 11, the displacement amount of the volume can be increased.

Figure 3:
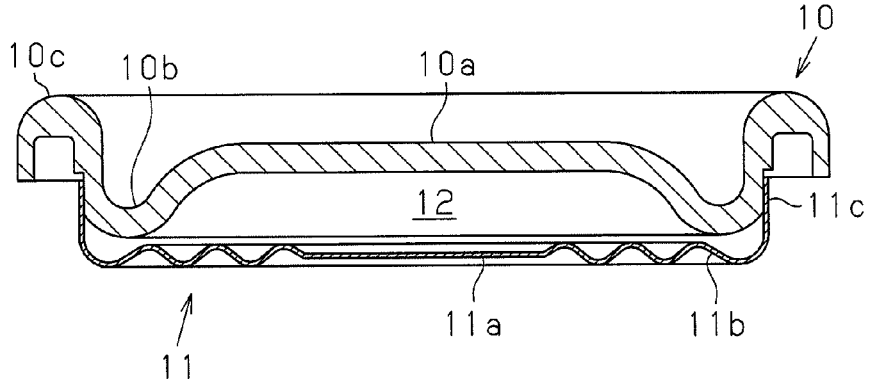
FIG. 3 is a cross-sectional view showing the cross-sectional structure of a pulsation damper according to a modification of the same embodiment.

The pulsation damper of the present embodiment may be modified as shown in FIG. 3. In this modification, a number of, for example, three, projections 11*b* are provided about the flat section 11*a*. However, the inventors have found out that the smaller the number of the projections 11*b*, the more remarkable the stress relaxing effect became. That is, as shown in FIG. 2, the structure in which only one projection 11*b* is provided in the periphery of the diaphragm 11 achieves the most remarkable stress relaxing effect. Hereafter, the results of experiments performed by the inventors will be described with reference to FIGS. 4 and 5. The experiments were related to the relationship between the number of projections 11*b* provided about the flat section 11*a* of the diaphragm 11 and the stress relaxing effect.

Figure 4:
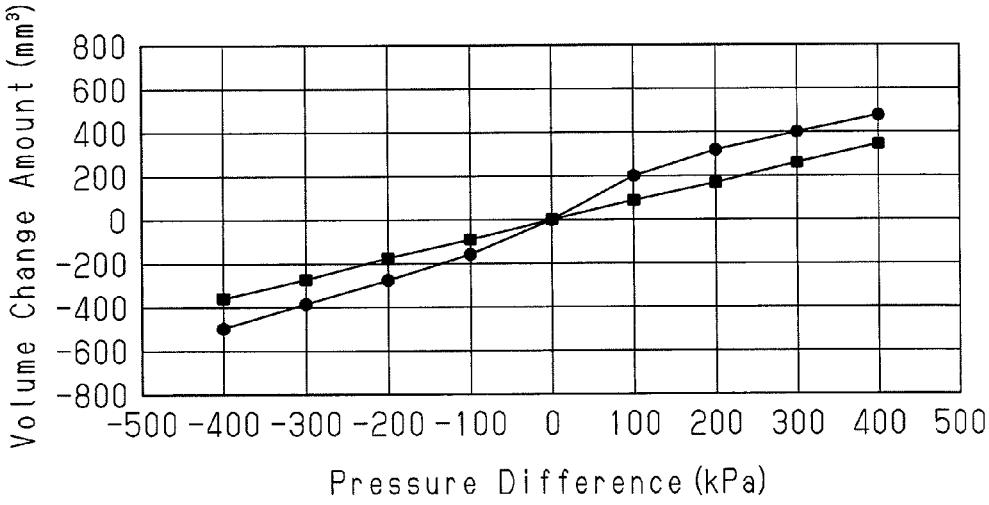
FIG. 4 is a graph showing a relationship between a pressure difference calculated by subtracting the pressure of gas sealed in a gas chamber from a fuel pressure, and corresponding changes in volume of the gas chamber.

FIG. 4 is a graph showing the relationship between a pressure difference, or the pressure obtained by subtracting the pressure of the inert gas sealed in the gas chamber 12 from the fuel pressure, and the amount of change in volume of the gas chamber 12, that is, the amount of displacement of the flat section 11*a* of the diaphragm 11. The black dots in the graph represent sampled values obtained from the structure shown in FIG. 2, and the black squares represent sampled values obtained from the structure shown in FIG. 3.

As obvious from FIG. 4, the amount of change in volume per unit pressure acting on the diaphragm 11 has a greater value when only one projection 11*b* is provided in the periphery of the diaphragm 11 either in a case where the pressure difference has a positive value, that is, when the fuel pressure is greater than the pressure of the inert gas sealed in the gas chamber 12, and the diaphragm 11 is deformed toward the pump chamber 23, or in a case where the pressure difference has a negative value, that is, when the diaphragm 11 is deformed toward the fuel chamber 23.

Figure 5:
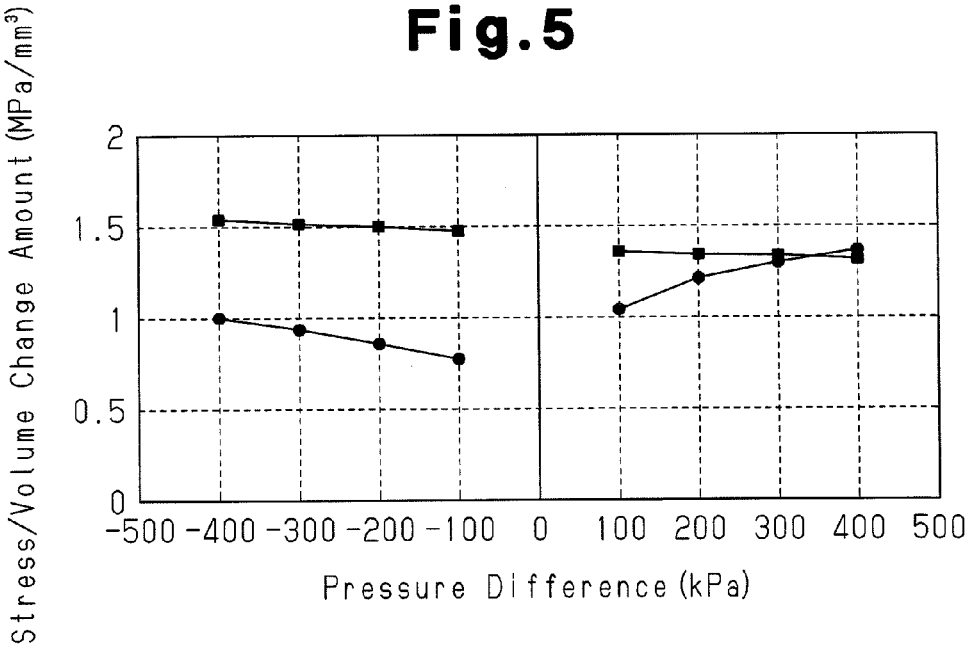
FIG. 5 is a graph showing a relationship between the pressure difference and the stress per unit amount of change in volume.

On the other hand, FIG. 5 is a graph showing the relationship between the pressure difference and the value obtained by dividing, by the amount of change in volume, the maximum value of stress generated when the diaphragm 11 is deformed. In this graph, as in FIG. 4, the black dots represent values obtained from the structure shown in FIG. 2, and the black squares represent values obtained from the structure shown in FIG. 3.

As obvious from FIG. 5, in a case where the pressure difference has a positive value, the stress per unit amount of change in volume is substantially the same between the structure shown in FIG. 2 and the structure shown in FIG. 3, when the pressure difference is 300 kPa. In contrast, in a case where the pressure difference is 400 kPa, the structure shown in FIG. 3 has smaller stress per unit amount of change in volume than the structure shown in FIG. 2. However, the difference is substantially equal to zero. When the pressure difference has a positive value, and between 100 and 200 kPa, the structure shown in FIG. 2 has a smaller stress per unit amount of change in volume. On the other hand, in a case where the pressure difference has a negative value, the smaller the absolute value of the pressure difference, the greater the difference by which the stress per amount of change in volume of the structure shown in FIG. 2 is smaller than that of FIG. 3 becomes. Further, in the range of the pressure difference between −100 to −400 kPa, the stress per unit amount of change in volume of the structure shown in FIG. 2 is 1.5 times smaller than the structure shown in FIG. 3.

With reference to the results shown in FIGS. 4 and 5, regardless whether the pressure difference has a positive or negative value or the magnitude of the pressure difference, the structure shown in FIG. 2 achieves a greater amount of change in volume than the structure shown in FIG. 3. Also, the structure shown in FIG. 2 generally has smaller stress per unit amount of change in volume than that of FIG. 3. Even if the stress per unit amount of change is greater in FIG. 2, the different is substantially zero. That is, by providing only one projection 11*b* about the diaphragm 11, the stress relaxing effect and the effect of amount of change in volume are remarkable compared to a case where a multiple, for example, three projections 11*b* are formed.

As described above, the pulsation damper according to the present embodiment has the following advantages.

(1) The cylindrical circumferential section, which perpendicularly extends from the flat section 11*a* of the diaphragm 11 via the projection 11*b*, is fitted about the pump cover 10. In this state, the fitting section of the cylindrical circumferential section is welded to the pump cover 10. That is, the diaphragm 11 and the pump cover 10 are assembled such that the joint section 11*c* and the flat section 11*a* are perpendicular to each other. Thus, even if the pressure caused by changes in volume of the gas chamber 12 due to displacement of the flat section 11*a* acts on the welded section between the cylindrical circumferential section and the pump cover 10, the pressure does not act in a direction for separating the joint section 11*c* from the pump cover 10. Therefore, the reliability of the joint between the pump cover 10 and the joint section 11*c* is maintained at a high level.

(2) The projection 11*b*, which has an arcuate cross-sectional shape bulging in a direction opposite to the pump cover 10, is formed in a part surrounding the flat section 11*a*, on which stress is concentrated when the diaphragm 11 is displaced, that is, in a periphery continuous to the cylindrical circumferential section of the diaphragm 11. This relaxes the stress concentrated on the periphery, and thus maintains the reliability of the joint section 11*c* at a high level. That is, this further improves the pressure tolerance of the entire pulsation damper.

(3) As in the modification of the present embodiment shown in FIG. 3, a plurality of projections 11*b* may be provided in the periphery of the diaphragm 11. When only one projection 11*b* is provided in the periphery of the diaphragm 11, a remarkable stress relaxing effect is achieved, and the reliability at the joint section 11*c* can be maintained at a high level.

(4) As a support member for the diaphragm 11, the pump cover 10 of the high-pressure fuel pump 20 is employed. The number of components of the high-pressure fuel pump 20 can be reduced, and the size of the high-pressure fuel pump 20 is maintained to be minimized.

The above described embodiment and its modification may be modified as shown below.

Figure 6:
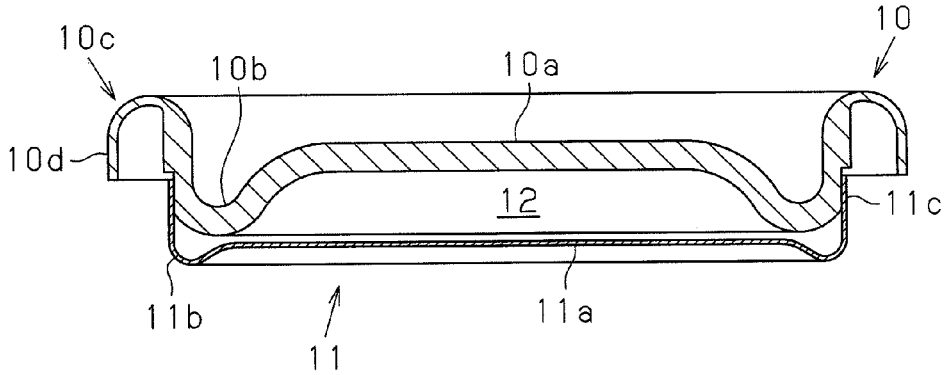
FIG. 6 is a cross-sectional view showing the cross-sectional structure of a pulsation damper according to another embodiment.
Figure 7:
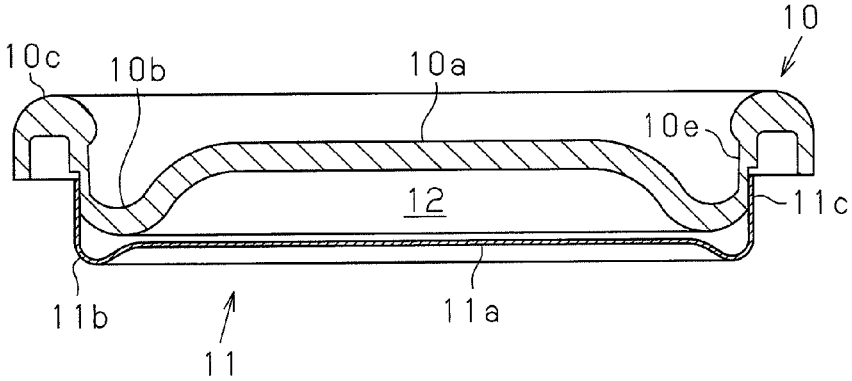
FIG. 7 is a cross-sectional view showing the cross-sectional structure of a pulsation damper according to another embodiment.
Figure 8:
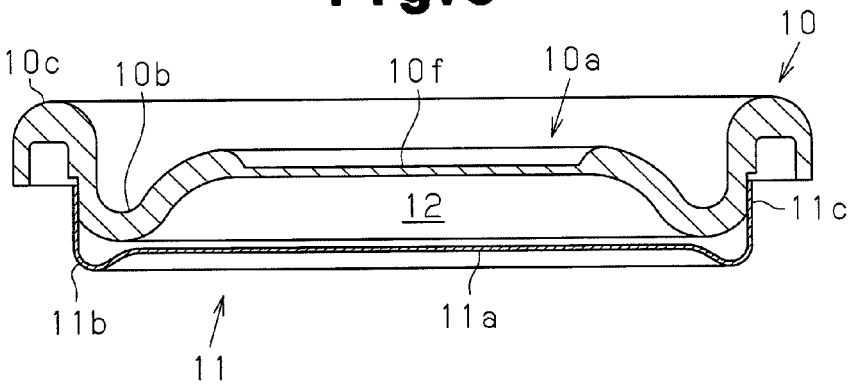
FIG. 8 is a cross-sectional view showing the cross-sectional structure of a pulsation damper according to another embodiment.

As shown in FIG. 2 or FIG. 3, which show a modification, the pump cover 10 forming the pulsation damper substantially has a constant thickness. However, the rigidity of the pump cover 10 may be reduced by any of the following configurations.

a. As shown in FIG. 6, which corresponds to FIG. 2, the hook section 10*c* may have a thin section 10*d*, which is thinner than the remainder of the pump cover 10.

b. As shown in FIG. 7, which corresponds to FIG. 2, a thin section 10*e* may be provided in a circumferential section that is perpendicular to the flat section 10*a* and projects in a direction opposite to the bulging direction of the projection 10*b*, that is, in a part to which the diaphragm 11 is welded.

c. As shown in FIG. 8, which corresponds to FIG. 2, a thin section 10*f* may be formed in the flat section 10*a* of the pump cover 10.

These configurations provide the following advantage in addition to the above advantages (1) to (4).

(5) The amount of displacement of the pulsation damper in accordance with pressure applied to the flat section 11*a* of the diaphragm 11 can be increased by the amount of flexing of low rigidity sections, or the thin sections 10*d*, 10*e*, 10*f*. That is, in addition to displacement of the diaphragm 11, the pump cover 10 serving as a support member can absorb pressure pulsation generated in fuel, so that the pressure pulsation reduction effect is maintained at a high level.

Instead of reducing the rigidity of the pump cover 10 by providing the thin sections 10*d*, 10*e*, 10*f*, the parts that correspond to the thin sections may be formed of a material different from the material of the remaining parts, or of a material having a lower rigidity than the remaining parts, so that the rigidity of the pump cover 10 is reduced. However, different types of stainless steel materials, which are preferable as the materials for the pump cover 10, do not vary significantly in rigidity. Also, forming the pump cover 10 of different materials requires complicated processes. Thus, reduction of the rigidity of the pump cover 10 is practically most easily and effectively achieved by providing the thin section 10*d*, 10*e*, or 10*f*.

In the illustrated embodiment, the diaphragm 11 is fitted about the pump cover 10. However, the diaphragm 11 may be fitted inside the pump cover 10.

When assembling the pump cover 10 and the diaphragm 11 together, the distal end of the periphery of the diaphragm 11 is press-fitted about the periphery of the pump cover 10, and then the press-fitted section is welded to fix the diaphragm 11 to the pump cover 10. However, the diaphragm 11 may be joined to the pump cover 10 by a method other than welding. For example, the diaphragm 11 may be joined to the pump cover 10 by fixing the press-fitted section by adhesive or brazing.

The pump cover 10 of the high-pressure fuel pump 20 also functions as a support member supporting the diaphragm 11. However, the diaphragm 11 may be supported by an additional member provided separately from the pump cover 10.

In the pulsation damper according to the modification shown in FIG. 3, the diaphragm 11 has three projections 11*b* of the same widths. However, the widths of the projections may be different. Nevertheless, the pulsation damper shown in FIG. 2 is most favorable for relaxing the stress as described above.

The diaphragm 11 has at least one projection 11*b* in the periphery surrounding the flat section 11*a*. However, a diaphragm having no projection 11*b* may be used. That is, a diaphragm may be used in which a flat section 11*a* includes a displacement section having an appropriate curvature and continuous to the cylindrical circumferential section.

The invention claimed is:

1. A pulsation damper provided for a fuel chamber of a high-pressure fuel pump, the pulsation damper comprising:

a diaphragm having a displacement section that is displaced by pressure acting there against, the diaphragm reducing pressure pulsation in the fuel chamber by means of displacement of the displacement section; and a pump cover of the high-pressure fuel pump for supporting the diaphragm, the pump cover, together with the diaphragm, forms a gas chamber, wherein the displacement section includes an annular projection and a flat section that has a flat surface facing the gas chamber and a flat surface facing the fuel chamber, the annular projection surrounding the flat section, the pump cover includes an annular projection and a flat section that has a flat surface facing the gas chamber, the flat surface parallel to the flat surface of the displacement section that faces the gas chamber, the annular projection of the pump cover surrounding the flat section of the pump cover, the diaphragm is shaped like a lidded cylinder and has a bottom, which is formed by the displacement section, and a cylindrical circumferential section, which extends perpendicularly from the displacement section and continues to an outer periphery of the annular projection, the annular projection of the displacement section has an arcuate cross-sectional shape to bulge into the fuel chamber with respect to the flat section of the displacement section, the cylindrical circumferential section is perpendicular to the flat section of the displacement section, extends in a direction opposite to the bulging direction of the annular projection of the displacement section, and an inner circumferential surface of the cylindrical circumferential section has a fitting section that is joined to an outer circumferential surface of the annular projection of the pump cover while being fitted about the outer circumferential surface of the annular projection of the pump cover, and a whole outer circumferential surface of the cylindrical circumferential section faces and is exposed to the fuel chamber.

2. The pulsation damper according to claim 1, wherein the pump cover partially has a low rigidity section with low rigidity.

3. The pulsation damper according to claim 2, wherein the pump cover is attached to an upper end cylindrical section of a housing of the high-pressure fuel pump, and the thickness of the pump cover is reduced in a part attached to the upper end cylindrical portion, so that the low rigidity section is formed in the part.

4. The pulsation damper according to claim 2, wherein the thickness of the pump cover is reduced in a part to which the cylindrical circumferential section of the diaphragm is joined, so that the low rigidity section is formed in the part.

5. The pulsation damper according to claim 2, wherein the thickness of the pump cover is reduced in a part that faces the displacement section of the diaphragm, so that the low rigidity section is formed in the part.

* * * * *